US010287801B1

(12) United States Patent
Huang

(10) Patent No.: US 10,287,801 B1
(45) Date of Patent: May 14, 2019

(54) DOOR LOCK ALARM

(71) Applicant: PHILIO TECHNOLOGY CORPORATION, New Taipei (TW)

(72) Inventor: Cheng-Hung Huang, New Taipei (TW)

(73) Assignee: PHILIO TECHNOLOGY CORPORATION, New Taipei (TW)

( * ) Notice: Subject to any disclaimer, the term of this patent is extended or adjusted under 35 U.S.C. 154(b) by 0 days.

(21) Appl. No.: 15/841,054

(22) Filed: Dec. 13, 2017

(51) Int. Cl.
*E05B 41/00* (2006.01)
*E05B 45/06* (2006.01)
*G08B 21/24* (2006.01)

(52) U.S. Cl.
CPC ..... *E05B 45/06* (2013.01); *G08B 21/24* (2013.01); *E05B 2045/0665* (2013.01)

(58) Field of Classification Search
CPC ..... G08B 13/08; G08B 13/02; G08B 13/06; G08B 23/00; G08B 25/008; G08B 29/10; G08B 29/14
See application file for complete search history.

(56) References Cited

U.S. PATENT DOCUMENTS

2010/0313612 A1* 12/2010 Eichenstein ..... E05B 15/0205 70/124

* cited by examiner

*Primary Examiner* — Hongmin Fan

(57) ABSTRACT

A door lock alarm includes a housing affixed to a door panel that carries a door lock and is hinged to a door frame, and a sensor including a circuit substrate mounted in the housing, a microprocessor installed in the circuit substrate, a sensor component electrically coupled to the microprocessor to face toward the door lock for detecting the presence of the latch bolt of the door lock in the locking position and providing a corresponding signal to the microprocessor so that the microprocessor activates alarm to give off an alarm signal upon receipt of the signal from the sensor component.

6 Claims, 9 Drawing Sheets

DOOR LOCK ALARM

BACKGROUND OF THE INVENTION

1. Field of the Invention

The present invention relates to alarm technology and more particularly to a door lock alarm, which gives off an alarm signal if the door lock is not locked after closing of the door panel to the door frame.

2. Description of the Related Art

The door panel of the door of a house is normally equipped with a door lock. If users forget to lock the door after access, thieves can get into the house to steal things, or to endanger the personal safety of residents. An advanced electronic door lock has the function of giving off a warning signal if the door lock is not locked. However, it costs a lot to replace an existing conventional door lock with an advanced electronic door lock. Further, certain door panels are not suitable for mounting an advanced electronic door lock. Therefore, it is desirable to provide an alarm for use in a door panel being equipped with a conventional door lock, which can give off an alarm signal if the door lock is not locked after the door is closed.

SUMMARY OF THE INVENTION

The present invention has been accomplished under the circumstances in view. It is therefore the main object of the present invention to provide a door lock alarm, which gives off an alarm signal if the door lock is not locked after closing of the door panel to the door frame.

To achieve this and other objects of the present invention, a door lock alarm comprises a housing and a sensor. The housing comprises a base frame affixed to a surface of a door panel that carries a door lock and is hinged to a door frame, a sensor holder frame perpendicularly connected to the base frame and abutted to an outer peripheral edge of the door panel, and at least one opening defined in one side of the sensor holder frame. The sensor is mounted in the housing, comprising a circuit substrate, a microprocessor installed in the circuit substrate, at least one sensor component and an alarm device. The at least one sensor component and the alarm device are respectively electrically coupled to the microprocessor through the circuit substrate. The at least one sensor component is mounted in the housing and respectively extended out of the at least one opening to face toward the door lock for detecting the presence of a latch bolt of the door lock in a locking position and providing a corresponding signal to the microprocessor. The microprocessor is adapted for receiving the signal from the at least one sensor component and activating the alarm to give off an alarm signal upon receipt of the signal from the at least one sensor component.

Preferably, the sensor further comprises a reed switch electrically coupled to the microprocessor through the circuit substrate and adapted for providing a signal to the microprocessor for activating the at least sensor component upon closing of the door panel to the door frame.

Preferably, the housing comprises a plurality of openings arranged in a row; the sensor comprises a plurality of sensor components respectively extended out of the openings of the housing.

Further, the alarm device of the sensor can be a buzzer, a warning light, or a communication module.

DETAILED DESCRIPTION OF THE PREFERRED EMBODIMENT

Figure 1:
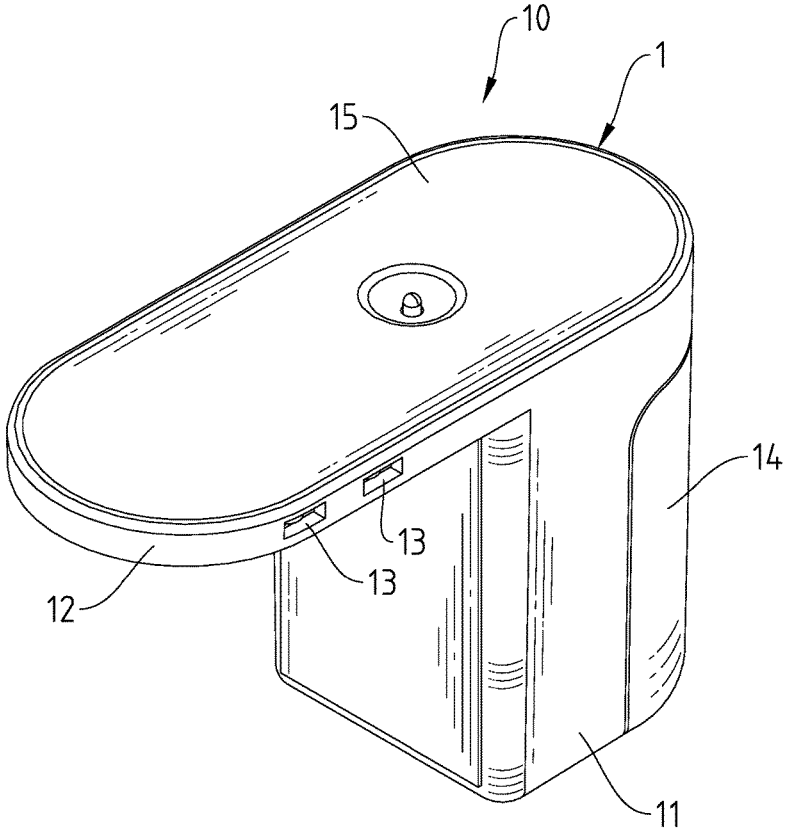
FIG. 1 is an oblique top elevational view of a door lock alarm in accordance with the present invention.
Figure 2:
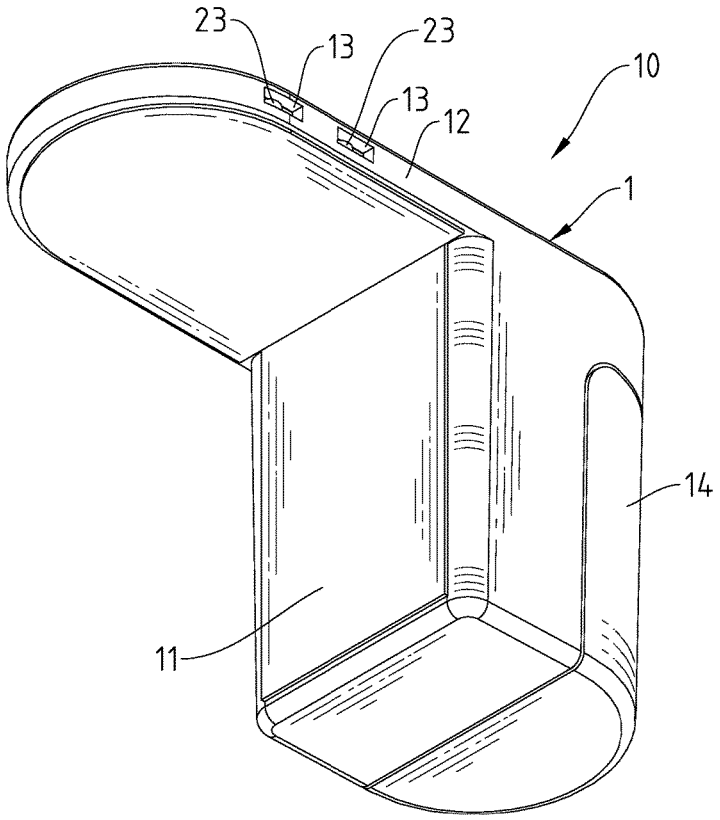
FIG. 2 is an oblique bottom elevational view of the door lock alarm in accordance with the present invention.
Figure 3:
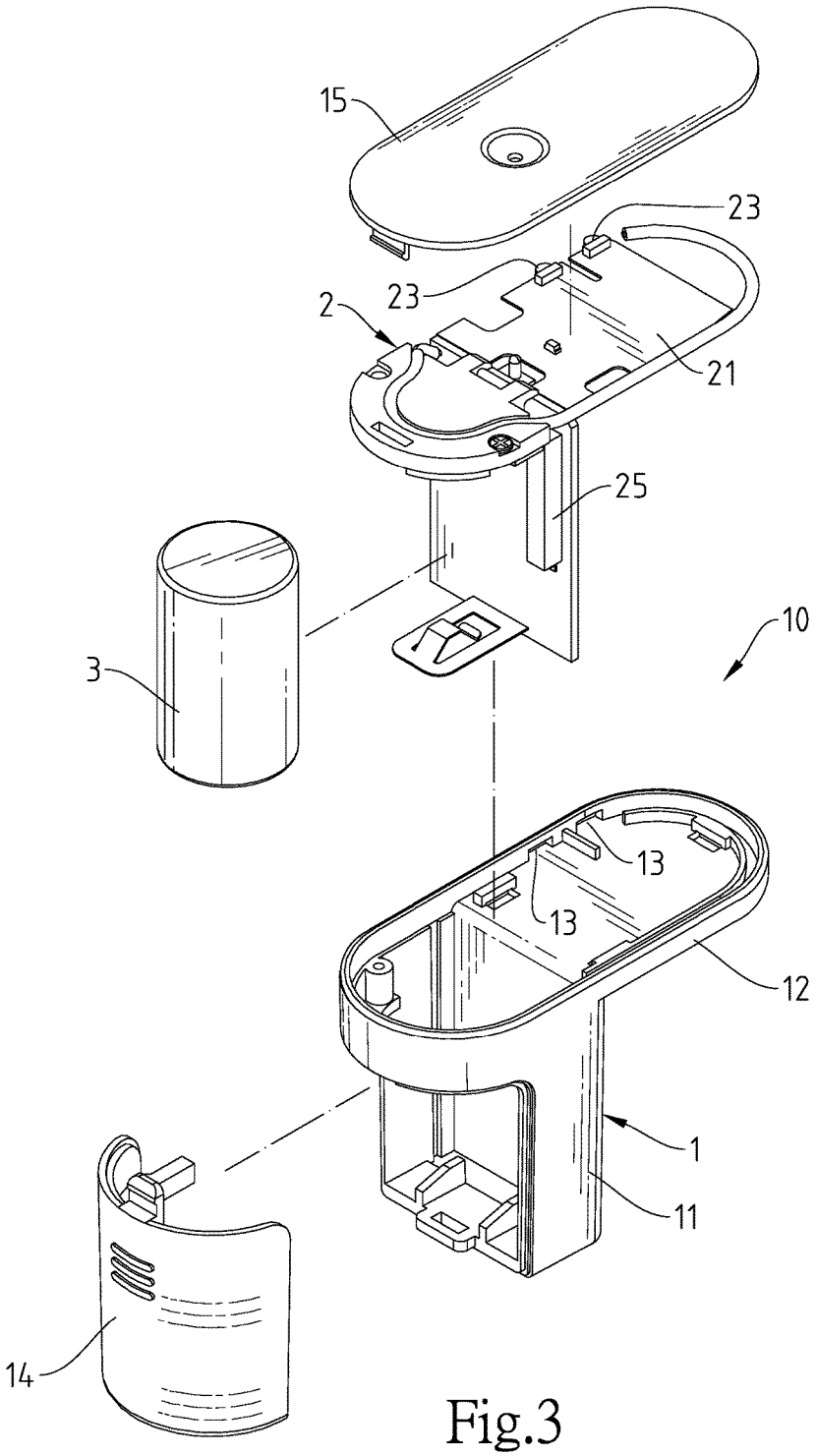
FIG. 3 is an exploded view of the door lock alarm in accordance with the present invention.
Figure 4:
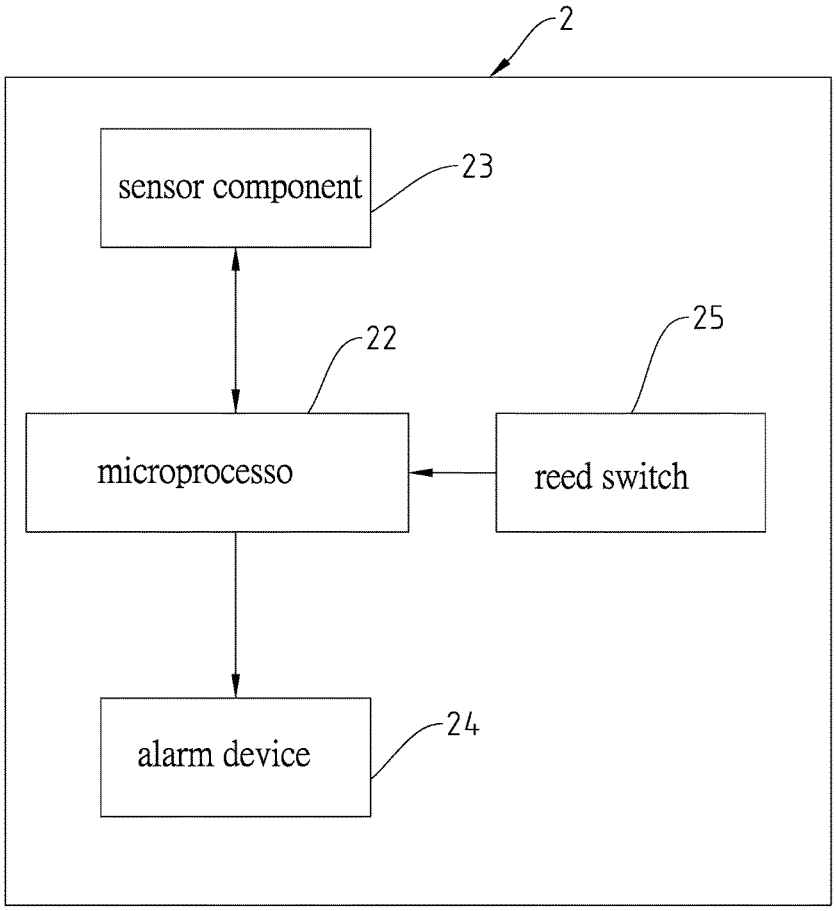
FIG. 4 is a circuit block diagram of the sensor of the door lock alarm in accordance with the present invention.
Figure 5:
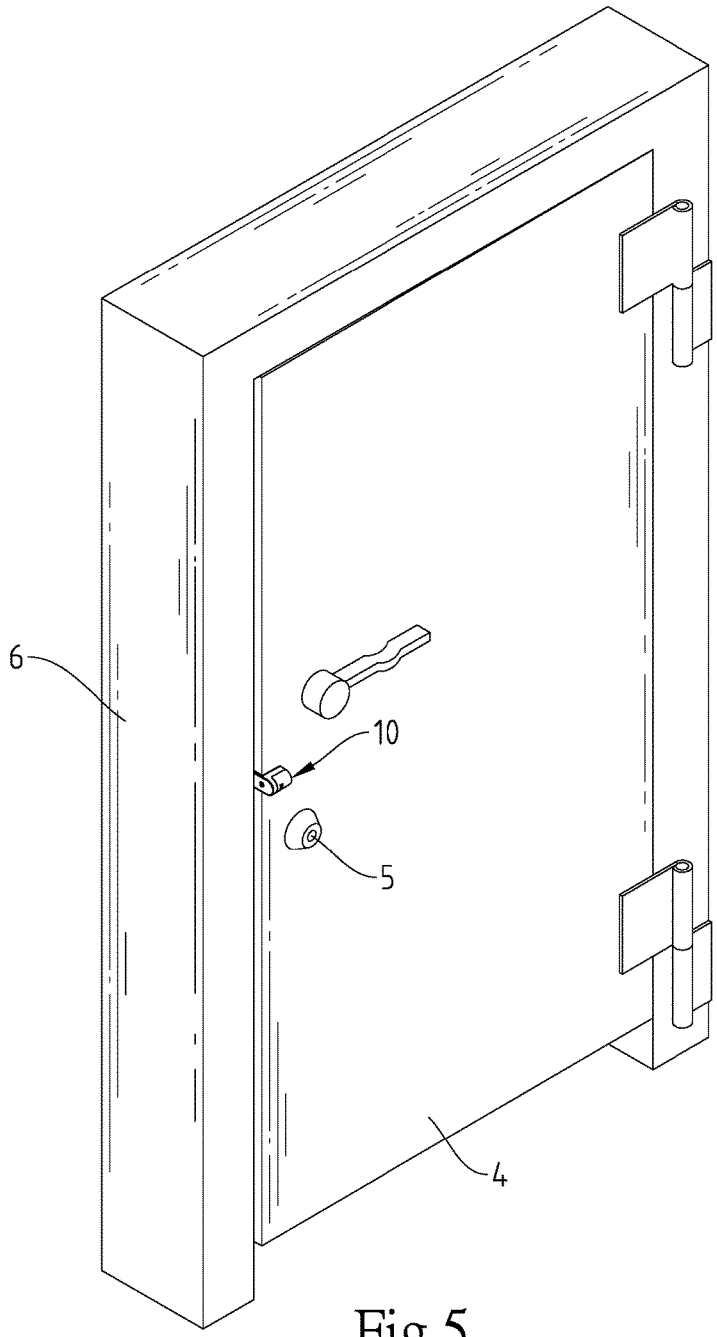
FIG. 5 is an applied view of the present invention, illustrating the door lock alarm installed in a door panel of a door.
Figure 6:
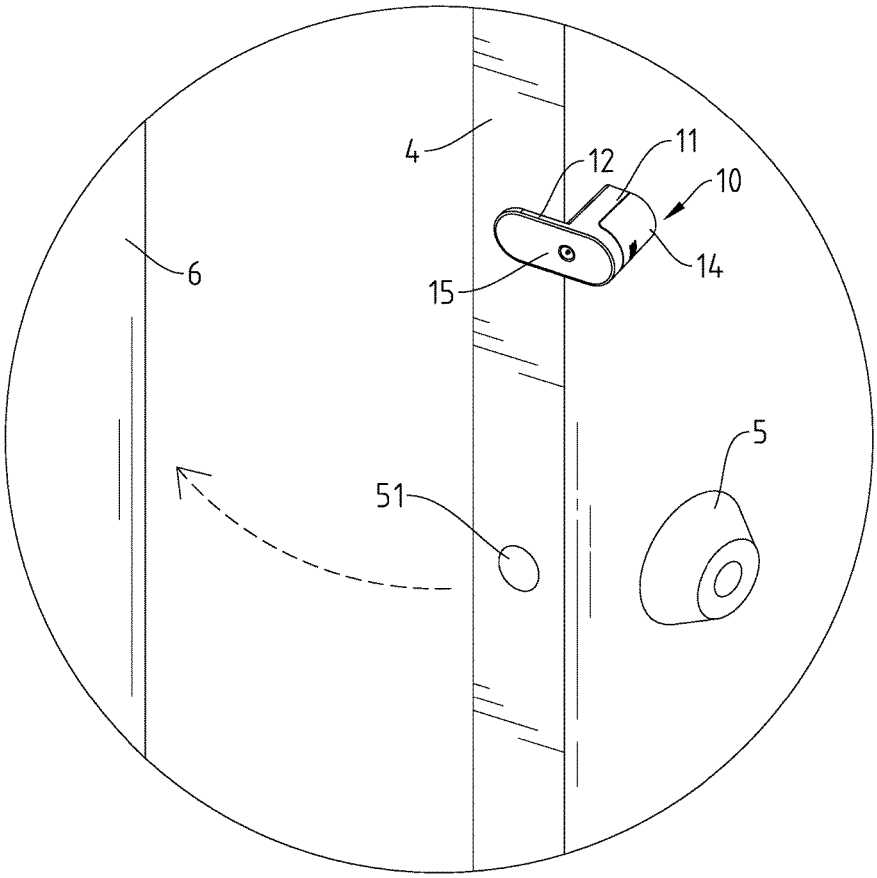
FIG. 6 is a schematic operational view illustrating the door lock sensor moved with the door panel relative to the door frame.
Figure 7:
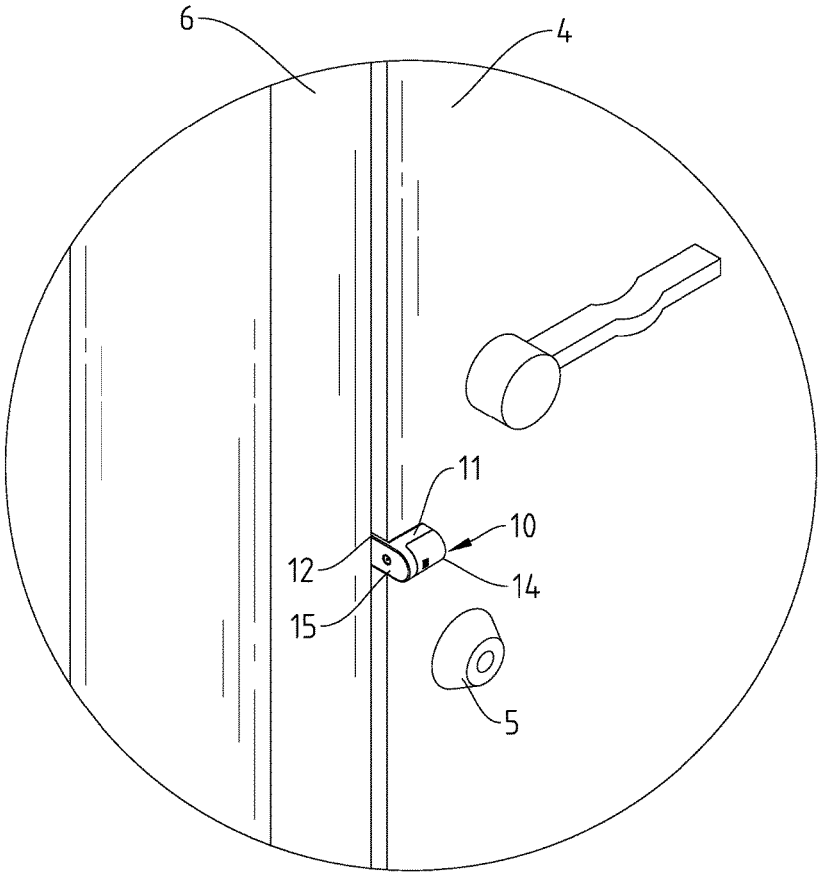
FIG. 7 corresponds to FIG. 6, illustrating the door panel closed to the door frame.

Referring to FIGS. 1-4, a door lock alarm 10 in accordance with the present invention generally comprises a housing 1 and a sensor 2.

The housing 1 comprises a base frame 11, a sensor holder frame 12 perpendicularly connected to a top side of the base frame 11, at least one opening 13 defined in one side of the sensor holder frame 12, a side cover 14 covering a front side of the base frame 11, a battery 3 mounted in the base frame 11 to provide the sensor 2 with the necessary working power supply, and a top cover 15 covering a top side of the sensor holder frame 12.

The sensor 2 is mounted in the housing 1, comprising a circuit substrate 21, and a microprocessor 22, at least one sensor component 23, an alarm device 24 and a reed switch 25 respectively electrically connected to the circuit substrate 21. The at least one sensor component 23, the alarm device 24 and the reed switch 25 are electrically coupled to the microprocessor 22 through the circuit substrate 21. The at least one sensor component 23 protrudes over the housing 1 through the at least one opening 13.

Preferably, the housing 1 is configured to provide multiple openings 13 arranged in a row; the sensor 2 is configured to provide a plurality of sensor components 23 respectively positioned in the respective openings 13 of the housing 1. Further, the alarm device 24 of the sensor 2 can be a buzzer or warning light, or a communication module capable of transmitting an alarm message to a remote mobile electronic product.

Figure 8:
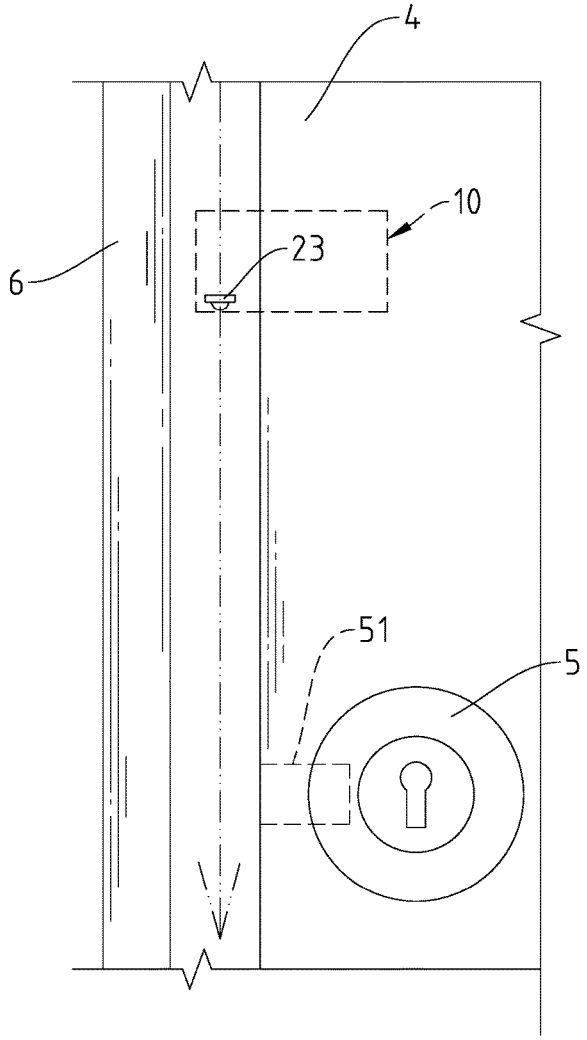
FIG. 8 is a schematic drawing illustrating a sensing operation of the sensor of the door lock alarm where the latch bolt of the door lock is in the unlocking position.
Figure 9:
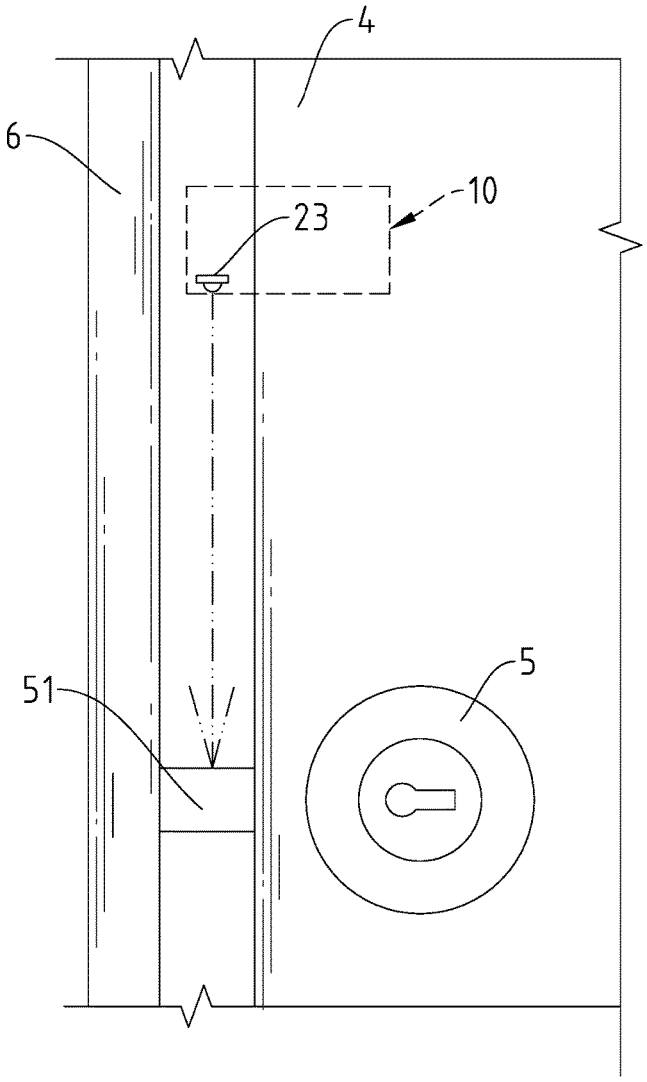
FIG. 9 corresponds to FIG. 8, illustrating the latch bolt of the door lock in the locking position.

Referring to FIGS. 5-9 and FIGS. 1 and 4 again, in application of the door lock alarm 10, affix the base frame 11 of the housing 1 to the surface of the door panel 4 to hold the sensor holder frame 12 at the outer peripheral edge of the door panel 4, keeping the openings 13 to face toward the door lock 5 at the door panel 4. When the door panel 4 is closed to the door frame 6, the sensor holder frame 12 is disposed between the door panel 4 and the door frame 6. At this time, the reed switch 25 is activated to provide a signal to the microprocessor 22. Upon receipt of the signal from the reed switch 25, the microprocessor 22 activates the sensor components 23 to detect the presence of the latch bolt 51 of the door lock 5. If the latch bolt 51 of the door lock 5 is not extended out of the door panel 4 from the unlocking position to the locking position, as illustrated in FIG. 8, the sensor components 23 are activated to provide a signal to the microprocessor 22, causing the microprocessor 22 to activate the alarm device 24 in giving off an alarm signal. If the latch bolt 51 of the door lock 5 is extended out of the door panel 4 from the unlocking position to the locking position, as illustrated in FIG. 9, the sensor components 23 do not give any signal, and thus, the microprocessor 22 does not activate the alarm device 24.

What is claimed is:

1. A door lock alarm, comprising:

a housing comprising a base frame configured to be affixed to a surface of a door panel that carries a door lock and is hinged to a door frame, a sensor holder frame perpendicularly connected to said base frame and configured to abut an outer peripheral edge of said door panel, and at least one opening defined in a side of said sensor holder frame; and a sensor mounted in said housing, said sensor comprising a circuit substrate, a microprocessor installed on said circuit substrate, at least one sensor component and an alarm device, said at least one sensor component and said alarm device being respectively electrically coupled to said microprocessor through said circuit substrate, said at least one sensor component being mounted in said housing and respectively extending out of said at least one opening to face toward said door lock for detecting whether or not a latch bolt of said door lock is in a locking position and providing a corresponding signal to said microprocessor, wherein said microprocessor is adapted for receiving said signal from said at least one sensor component and activating said alarm to give off an alarm signal upon receipt of said signal from said at least one sensor component if said signal indicates that said latch bolt is not in the locking position.

2. The door lock alarm as claimed in claim 1, wherein said sensor further comprises a reed switch electrically coupled to said microprocessor through said circuit substrate and adapted for providing a signal to said microprocessor for activating said at least sensor component upon closing of said door panel to said door frame.

3. The door lock alarm as claimed in claim 1, wherein said housing comprises a plurality of said openings arranged in a row, and said sensor comprises a plurality of said sensor components respectively extended out of said openings of said housing.

4. The door lock alarm as claimed in claim 1, wherein said alarm device of said sensor is a buzzer.

5. The door lock alarm as claimed in claim 1, wherein said alarm device of said sensor is a warning light.

6. The door lock alarm as claimed in claim 1, wherein said alarm device of said sensor is a communication module.

* * * * *